US008492996B2

(12) United States Patent
Gehman

(10) Patent No.: US 8,492,996 B2
(45) **Date of Patent: *Jul. 23, 2013**

(54) DIMMER SWITCH WITH ADJUSTABLE HIGH-END TRIM

(75) Inventor: Jackson Gehman, Coopersburg, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/437,130

(22) Filed: Apr. 2, 2012

(65) Prior Publication Data

US 2012/0235591 A1 Sep. 20, 2012

Related U.S. Application Data

(60) Division of application No. 12/958,878, filed on Dec. 2, 2010, now Pat. No. 8,198,827, which is a continuation of application No. 11/514,659, filed on Sep. 1, 2006, now Pat. No. 7,906,916.

(60) Provisional application No. 60/812,337, filed on Jun. 8, 2006.

(51) Int. Cl.
*H05B 37/00* (2006.01)

(52) U.S. Cl.
USPC ..... 315/291; 315/360; 307/140

(58) Field of Classification Search
USPC ..... 315/291, 307, 308, 360, DIG. 4, 315/DIG. 7, DIG. 5, 362; 307/139, 140, 141, 307/115
See application file for complete search history.

(56) References Cited

U.S. PATENT DOCUMENTS

| | | | |
|---|---|---|---|
| 4,434,388 | A | 2/1984 | Carver et al. |
| 4,563,592 | A | 1/1986 | Yuhasz et al. |
| 4,689,547 | A | 8/1987 | Rowen et al. |
| 5,264,761 | A | 11/1993 | Johnson |
| 5,430,356 | A | 7/1995 | Ference et al. |
| 6,005,308 | A | 12/1999 | Bryde et al. |
| 6,046,550 | A | 4/2000 | Ference et al. |
| 6,188,181 | B1 | 2/2001 | Sinha et al. |
| 6,225,760 | B1 | 5/2001 | Moan |

(Continued)

OTHER PUBLICATIONS

European Patent Office, International Search Report and Written Opinion for International Patent Application No. PCT/US2007/013235, Nov. 7, 2007, 16 pages.

(Continued)

*Primary Examiner* — David H Vu
(74) *Attorney, Agent, or Firm* — Mark E. Rose; Philip N. Smith

(57) ABSTRACT

A dimmer switch has a user adjustable high-end trim. The dimmer switch includes a bidirectional semiconductor switch, such as a triac, for controlling the amount of power delivered from a source of alternating current power to a lighting load, such as an electric lamp. A user-adjustable timing circuit controls the conduction time of the triac from a minimum time to a maximum time to control the power delivered to the load between a low-end trim and a high-end trim. The timing circuit includes a user-accessible switch that allows a user to reduce the high-end trim from a first nominal level to a second reduced level, lower than the first level, without substantially affecting the low-end trim. The dimmer switch advantageously uses less energy and the lifetime of the lamp is extended when the second reduced level of the high-end trim is selected.

20 Claims, 10 Drawing Sheets

U.S. PATENT DOCUMENTS

| | | | | |
|---|---|---|---|---|
| 6,310,439 | B1 | 10/2001 | Jacoby, Jr. et al. | |
| 7,164,238 | B2 | 1/2007 | Kasanov et al. | |
| 7,501,774 | B2 * | 3/2009 | Hick et al. | 315/312 |
| 7,906,916 | B2 | 3/2011 | Gehman | |
| 8,198,827 | B2 | 6/2012 | Gehman | |
| 2005/0035729 | A1 * | 2/2005 | Lev et al. | 315/291 |
| 2006/0012315 | A1 | 1/2006 | McDonough et al. | |
| 2009/0256483 | A1 | 10/2009 | Gehman et al. | |

OTHER PUBLICATIONS

Lutron Electronics Co., Inc., Skylark Fluorescent Dimmers Installation Instructions, Aug. 1999, 4 pages.
Lutron Electronics Co., Inc., Nova Fluorescent Controls Installation Instructions, May 2007, 4 pages.

* cited by examiner

DIMMER SWITCH WITH ADJUSTABLE HIGH-END TRIM

RELATED APPLICATIONS

This application is a divisional application of commonly-assigned U.S. patent application Ser. No. 12/958,878, filed Dec. 2, 2010, now U.S. Pat. No. 8,198,827, entitled DIMMER SWITCH WITH ADJUSTABLE HIGH-END TRIM, which is a continuation application of commonly-assigned U.S. patent application Ser. No. 11/514,659, filed Sep. 1, 2006, now U.S. Pat. No. 7,906,916, entitled DIMMER SWITCH WITH ADJUSTABLE HIGH-END TRIM, which is a non-provisional of commonly-assigned U.S. Provisional Patent Application Ser. No. 60/812,337, filed Jun. 8, 2006, entitled DIMMER WITH ADJUSTABLE HIGH-END TRIM, the entire disclosures of which are hereby incorporated by reference.

BACKGROUND OF THE INVENTION

1. Field of the Invention

The present invention relates to load control devices for controlling the amount of power delivered to an electrical load, specifically a dimmer switch that controls the intensity of a lighting load. More particularly, the invention relates to a dimmer switch having a user-accessible switch for adjusting a high-end trim of the dimmer switch.

2. Description of the Related Art

A conventional wall-mounted load control device is mounted to a standard electrical wall box and is coupled between a source of alternating-current (AC) power (typically 50 or 60 Hz line voltage AC mains) and an electrical load. Standard load control devices, such as dimmers and dimmer switches, use one or more semiconductor switches, typically bidirectional semiconductor switches, such as triacs or field effect transistors (FETs), to control the current delivered to the load, and thus, the intensity of the light provided by the lighting load. The semiconductor switch is typically coupled in series between the source and the lighting load. Using a phase-control dimming technique, the dimmer renders the semiconductor switch conductive for a portion of each line half-cycle to provide power to the lighting load, and renders the semiconductor switch non-conductive for the other portion of the line half-cycle to disconnect power from the load. The ratio of the on-time, during which the semiconductor switch is conductive, to the off-time, during which the semiconductor switch is non-conductive, determines the intensity of the light produced by the lighting load.

Wall-mounted dimmer switches typically include a user interface having a means for adjusting the light intensity of the load, such as a linear slider, a rotary knob, or a rocker switch. Dimmer switches also typically include a button or switch that allows for toggling of the load from off (i.e., no power is conducted to the load) to on (i.e., power is conducted to the load), and vice versa.

Many people desire to save energy. One way to save energy in a dimmer is to adjust the high-end trim of the dimmer to limit the maximum amount of power that the dimmer will deliver to the lighting load. The high-end trim is the maximum amount of power that a dimmer is capable of delivering to a lighting load. The high-end trim is determined by the maximum possible on-time of the semiconductor switch. In contrast, the low-end trim is the minimum amount of power that a dimmer is capable of delivering to a lighting load, when the dimmer is on. The low-end trim is determined by the minimum possible on-time of the semiconductor switch when the semiconductor switch is conducting.

Prior art dimmer switches typically have fixed high-end trims and provide no user-accessible means for a user to be able to change the high-end trim. This is especially true of two-wire analog dimmer switches. There is, therefore, a need for a simple, low-cost, two-wire, analog dimmer having a user-accessible means for selecting a lower high-end trim.

SUMMARY OF THE INVENTION

In one embodiment of the present invention, a load control device with an adjustable high-end trim comprises a bidirectional semiconductor switch coupled in series electrical connection between the source and the load, and a user-accessible means for reducing the high-end trim of the load control device from a first level to a second level lower than the first level. The bidirectional semiconductor switch is operable to control the amount of power delivered to the electrical load between a low-end trim and the adjustable high-end trim, and has a control input for controlling the semiconductor switch in response to a firing voltage signal derived entirely from analog control circuitry. The adjustment actuator is mounted on a front surface of the load control device. The adjustment actuator is inaccessible to a user when a faceplate is mounted on the load control device, but is accessible to a user when the faceplate is not mounted on the load control device. Actuations of the user-accessible means for reducing have substantially no affect upon the low-end trim of the load control device.

Other features and advantages of the present invention will become apparent from the following description of the invention that refers to the accompanying drawings.

DETAILED DESCRIPTION OF THE INVENTION

Figure 1:
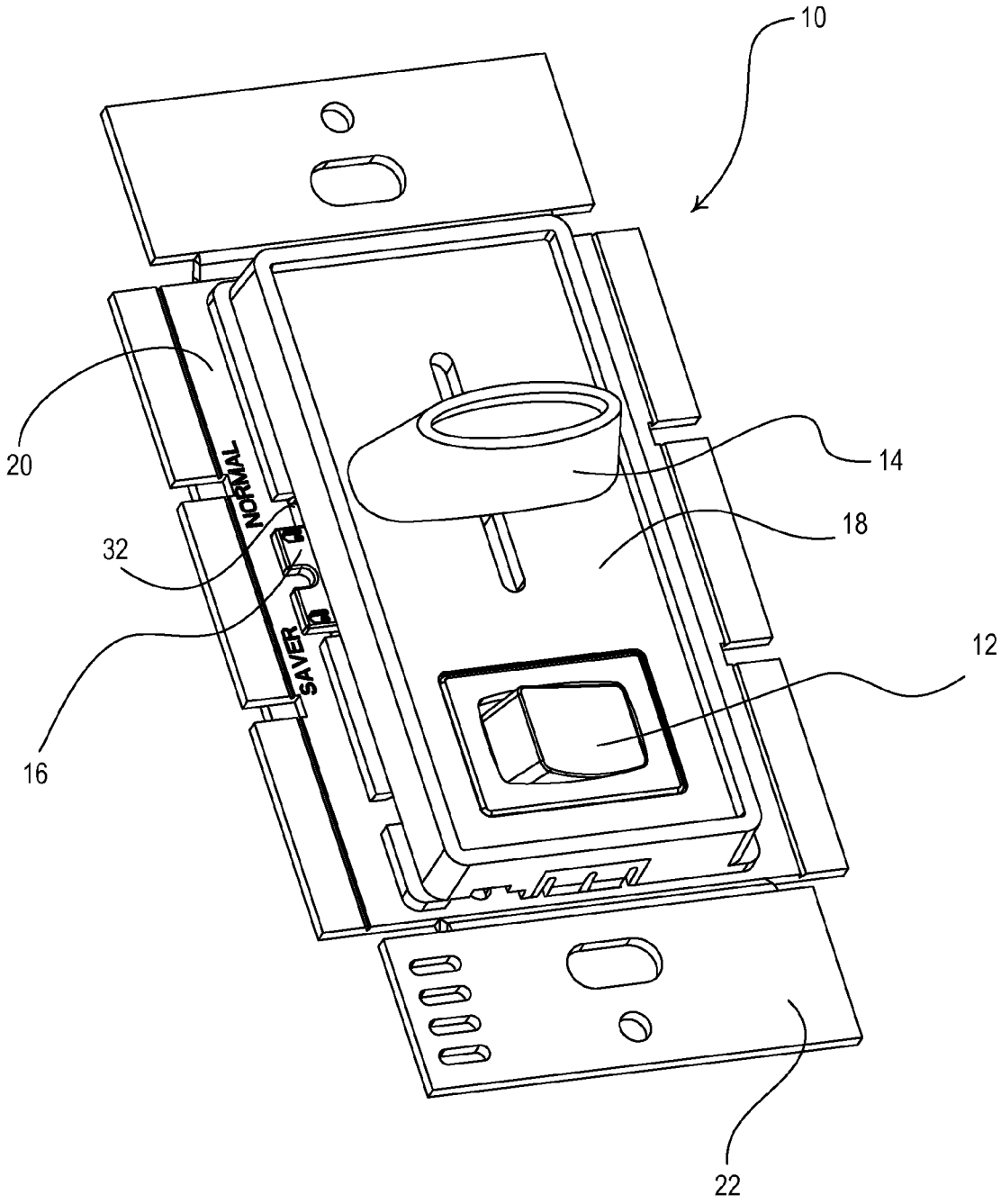
FIG. 1 is a perspective view of the user interface of a dimmer switch having an adjustable high-end trim.

The foregoing summary, as well as the following detailed description of the preferred embodiments, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

Figure 2:
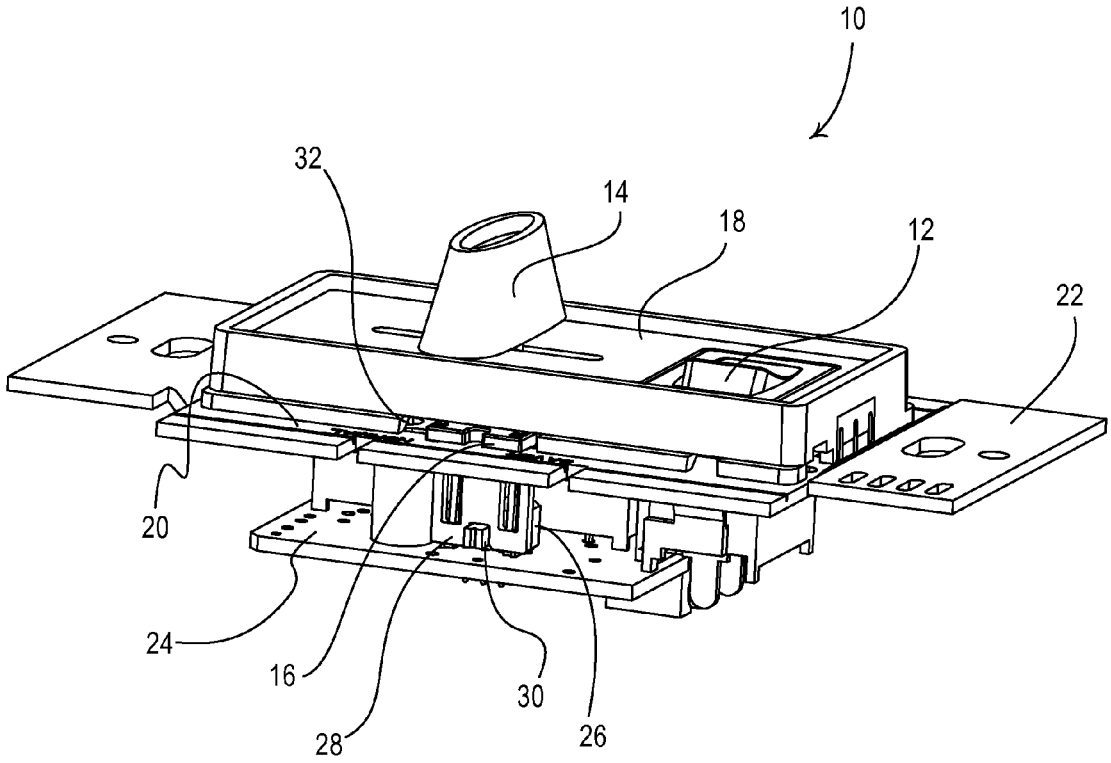
FIG. 2 is another perspective view of the user interface of FIG. 1.

FIG. 1 and FIG. 2 are perspective views of the user interface of a dimmer switch 10 having adjustable high-end trim. The dimmer switch 10 includes a rocker switch 12, a slider actuator 14 (i.e., an intensity adjustment actuator), and a user-accessible high-end trim adjustment actuator 16. The slider actuator 14 allows for turning on and off a connected lighting load, such as an electric lamp (e.g., a lighting load 108 shown in FIG. 3). The slider actuator 14 allows for adjusting the lighting level of the lighting load 108 from a minimum lighting level (i.e., the low-end trim level) to a maximum lighting level (i.e., the high-end trim level). The dimmer switch 10 also includes a bezel 18 attached to a front surface 20 of a mounting yoke 22 and a printed circuit board 24 mounted inside the dimmer switch 10. The bezel 18 is adapted to be received in an opening of a faceplate (not shown).

The high-end trim adjustment switch allows a user to change the dimmer switch 10 between a normal operating mode and an energy saver mode. When the dimmer switch 10 is in the normal operating mode, the high-end trim is set at a nominal high-end trim level. When the dimmer switch 10 is in the energy saver mode, the high-end trim is set at a reduced high-end trim level. Accordingly, the dimmer switch 10 uses less energy and the lifetime of the lamp is extended when the dimmer switch is in the energy saver mode.

The high-end trim adjustment actuator 16 is coupled to a mechanical switch 26 mounted on the printed circuit board 24 via a coupling member 28. The mechanical switch 26 includes an actuation knob 30, which is received in a notch in the coupling member. Accordingly, the high-end trim adjustment actuator 16 is provided through an opening 32 of the mounting yoke 22, such that the user is able to change the high-end trim from the user interface of the dimmer switch 10. Preferably, the adjustment actuator 16 is located such that the adjustment actuator cannot be seen when the faceplate is mounted to the dimmer switch 10, but can be accessed when the faceplate is removed.

Figure 3:
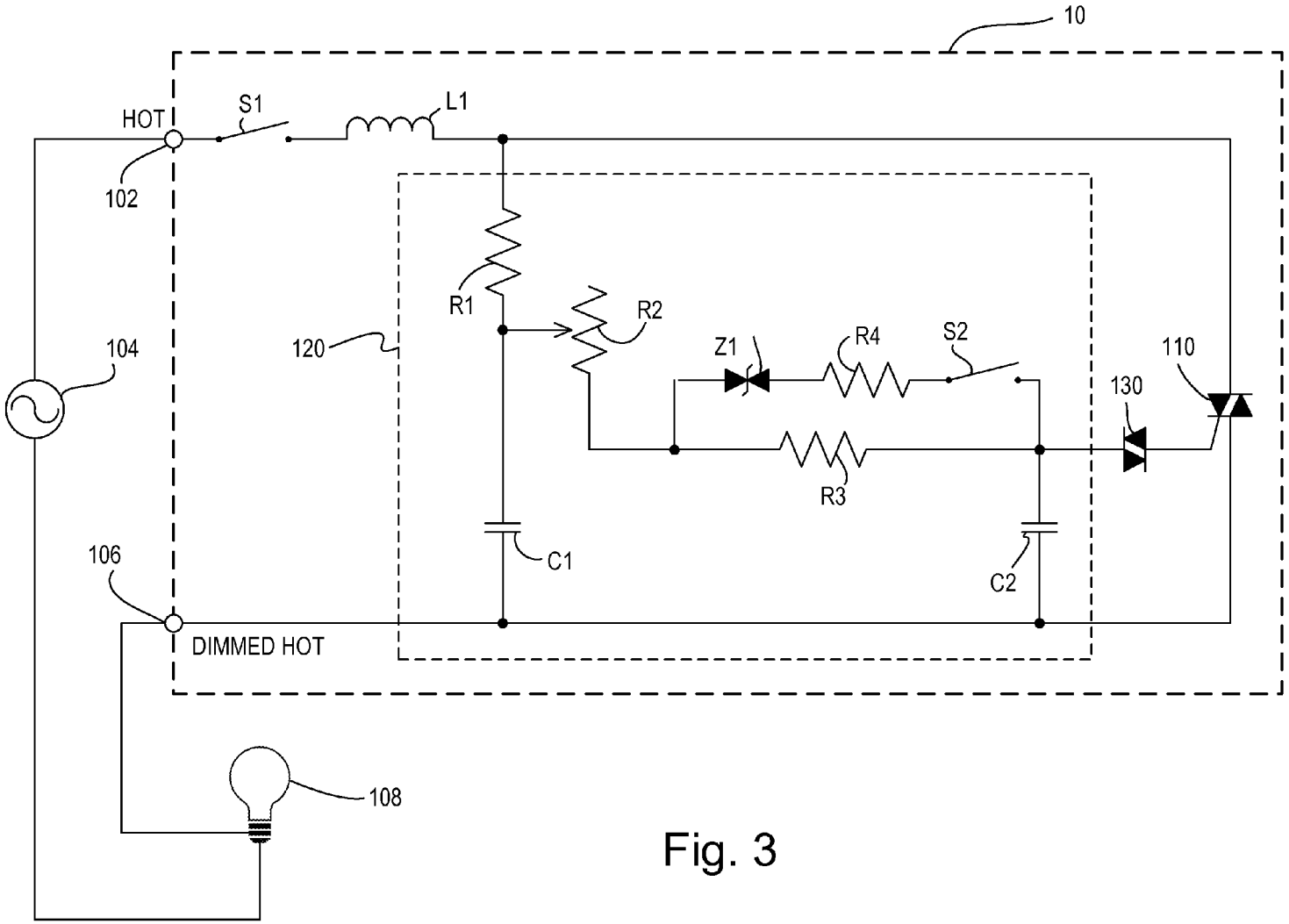
FIG. 3 is a simplified schematic diagram of the dimmer switch of FIG. 1 according to a first embodiment of the present invention.

FIG. 3 is a simplified electrical schematic diagram of the dimmer switch 10 according to a first embodiment of the present invention. The dimmer switch 10 includes a hot terminal 102 that is connected to an AC power source 104, and a dimmed hot terminal 106 that is connected to a lighting load 108, such as an electric lamp. The dimmer switch 10 includes a switch S1 connected to the hot terminal 102, a choke L1 connected in series with the switch S1, and a triac 110 connected in series between the choke L1 and the dimmed hot terminal 106. The triac 110 may alternatively be replaced by any suitable bidirectional switch, such as, for example, a field-effect transistor (FET) or an insulated gate bipolar junction transistor (IGBT) in a rectifier bridge, two FETs in anti-series connection, two IGBTs in anti-series connection, or a pair of silicon-controlled rectifiers. The switch S1 is the electrical representation of the rocker switch 12 of the user interface of the dimmer switch 10. When the switch S1 is open, no power is delivered to the lighting load 108. When the switch S1 is closed, the dimmer switch 10 is operable to control the amount of power delivered to the lighting load 108. The choke L1 operates as an electromagnetic interference (EMI) filter.

A timing circuit 120 is connected in parallel with the main leads of the triac 110. A diac 130 is connected in series between an output of the timing circuit 120 and a control lead (i.e., a gate) of the triac 110. The diac 130 may alternatively be replaced by any suitable triggering circuit or triggering device, such as, for example, a silicon bilateral switch (SBS).

The timing circuit 120 includes a resistor R1 connected to the junction of the choke L1 and a first main lead of the triac 110, and a capacitor C1 connected between the resistor R1 and the junction of the dimmed hot terminal 106 and a second main lead of the triac 110. Preferably, the resistor R1 has a resistance of 5.6 kΩ and the capacitor C1 has a capacitance of 0.1 μF. A wiper lead (or adjustable arm) of a potentiometer R2 is connected to the junction of the resistor R1 and the capacitor C1. The potentiometer R2 preferably has a value that can be varied from a minimum resistance (e.g., approximately 0Ω) up to a maximum value of about 300 kΩ. The potentiometer R2 is coupled to the slider actuator 14 and allows a user to adjust the light intensity level of the attached lighting load from the minimum light intensity level to the maximum light intensity level.

A second lead of the potentiometer R2 is connected to a first lead of a transient voltage suppressor Z1 and a first lead of a resistor R3, which preferably has a resistance of 31.6 kΩ. The transient voltage suppressor Z1 may comprise, for example, a pair of Zener diodes connected in series in reverse order or a TransZorb® transient voltage suppressor (manufactured by Vishay Intertechnology). The transient voltage suppressor Z1 preferably has a breakover voltage $V_Z$ of about 33.3V. The transient voltage suppressor Z1 has a second lead connected to a first lead of a resistor R4, which preferably has a resistance of 100Ω. The second lead of the resistor R4 is coupled to the first lead of a normally open single-pole single-throw switch S2. The switch S2 is the electrical representation of the user-accessible mechanical switch 26, which is actuated by the high-end trim adjustment actuator 16. A second lead of the switch S2 is connected to a second lead of the resistor R3. The junction of the second lead of the switch S2, the second lead of the resistor R3, and a first lead of a capacitor C2 comprises an output of the timing circuit 120 that is connected to a first lead of the diac 130. A second lead of the capacitor C2 is connected to the junction of a second lead of the capacitor C1, the second main lead of the triac 110, and the dimmed hot terminal 106. A second lead of the diac 130 is connected to the control lead of the triac 110.

In operation, the timing circuit 120 sets a firing voltage, which is the voltage across the capacitor C2, for turning on the triac 110 after a selected phase angle in each line voltage half-cycle. The charging time of the capacitor C2 is varied in response to a change in the resistance of the potentiometer R2 to change the selected phase angle at which the triac 110 begins conducting. The capacitor C2 preferably has a capacitance of 0.1 μF.

The diac 130 is in series with the control lead of the triac 110 and is used as a triggering device. The diac 130 has a breakover voltage $V_{BR}$ (for example 30V), and will conduct current to and from the triac control lead only when the firing voltage on the capacitor C2 exceeds substantially the breakover voltage $V_{BR}$ of the diac 130. A gate current flows into the control lead of the triac 110 during the positive half-cycles of the line voltage and out of the control lead of the triac 110 during the negative half-cycles.

When the switch S2 is closed, the dimmer switch 10 operates in the normal mode with the nominal high-end trim level. While the potentiometer R2 is at the minimum resistance and the switch S2 is closed, the firing voltage at the output of the timing circuit 120 increases from substantially zero volts to a predetermined voltage, i.e., the breakover voltage $V_{BR}$ of the diac 130, during a first period of time, i.e., at a first rate. Accordingly, the capacitor C2 charges for the first period of time before the diac 130 fires.

In contrast, when the switch S2 is open, the dimmer switch 10 operates in the energy saver mode with the reduced high-end trim level. While the potentiometer R2 is at the minimum resistance and the switch S2 is closed, the firing voltage at the output of the timing circuit 120 increases from substantially zero volts to the predetermined voltage during a second period of time, i.e., at a second rate. Accordingly, the capacitor C2 charges for the second period of time before the diac 130 fires. In both the normal mode and the energy saver mode, the user of the dimmer switch 10 may change the firing angle via the slider actuator 14 to decrease the amount of power delivered to the lighting load 108.

When switch S2 is closed, the series combination of the transient voltage suppressor Z1 and the resistor R4 is connected in parallel with the resistor R3. When the voltage developed across the resistor R3 exceeds substantially the breakover voltage $V_Z$ of the transient voltage suppressor Z1, the transient voltage suppressor Z1 conducts. Resistor R3 is then effectively short-circuited (since the resistance of resistor R4 is substantially small, i.e., 100Ω, compared to resistor R3). The total resistance in the charging path of the capacitor C2 is reduced, thereby shortening the time required for the capacitor C2 to charge to the breakover voltage $V_{BR}$ of the diac 130. Thus, the triac 110 begins conducting earlier than it would if the switch S2 were open, thereby raising the high-end trim to a higher level than when the switch S2 is open, i.e., with the nominal high-end trim level.

When the diac 130 fires, the voltage across the diac decreases to a breakback voltage $V_{BB}$, e.g., 25V. Since the voltage between the control input and the second main lead of the triac 110 is substantially zero volts, the voltage across the capacitor C2 decreases to substantially the breakback voltage $V_{BB}$ of the diac 130, i.e., decreases by approximately five (5) volts. As a result, the voltage across the series combination of the transient voltage suppressor Z1, the resistor R4, and the switch S2 increases by this difference, i.e., approximately five volts. The resistor R4 operates to protect the transient voltage suppressor Z1 by limiting the current that is conducted through the transient voltage suppressor at this time. Note that the resistor R4 is not an essential part. Alternatively, a transient voltage suppressor having a greater current rating could be used.

Accordingly, the dimmer switch 10 has a user-accessible adjustable high-end trim that is adjustable between the nominal high-end trim level when the switch S2 is closed, and the reduced high-end trim level when the switch S2 is open. The low-end trim is not affected by the state of the switch S2 because, at low-end, the value of the resistance of the potentiometer R2 is sufficiently high so that the charging current through the capacitor C2 remains sufficiently small so that the voltage developed across the resistor R3 never exceeds the breakover voltage $V_Z$ of the transient voltage suppressor Z1.

Figure 4:
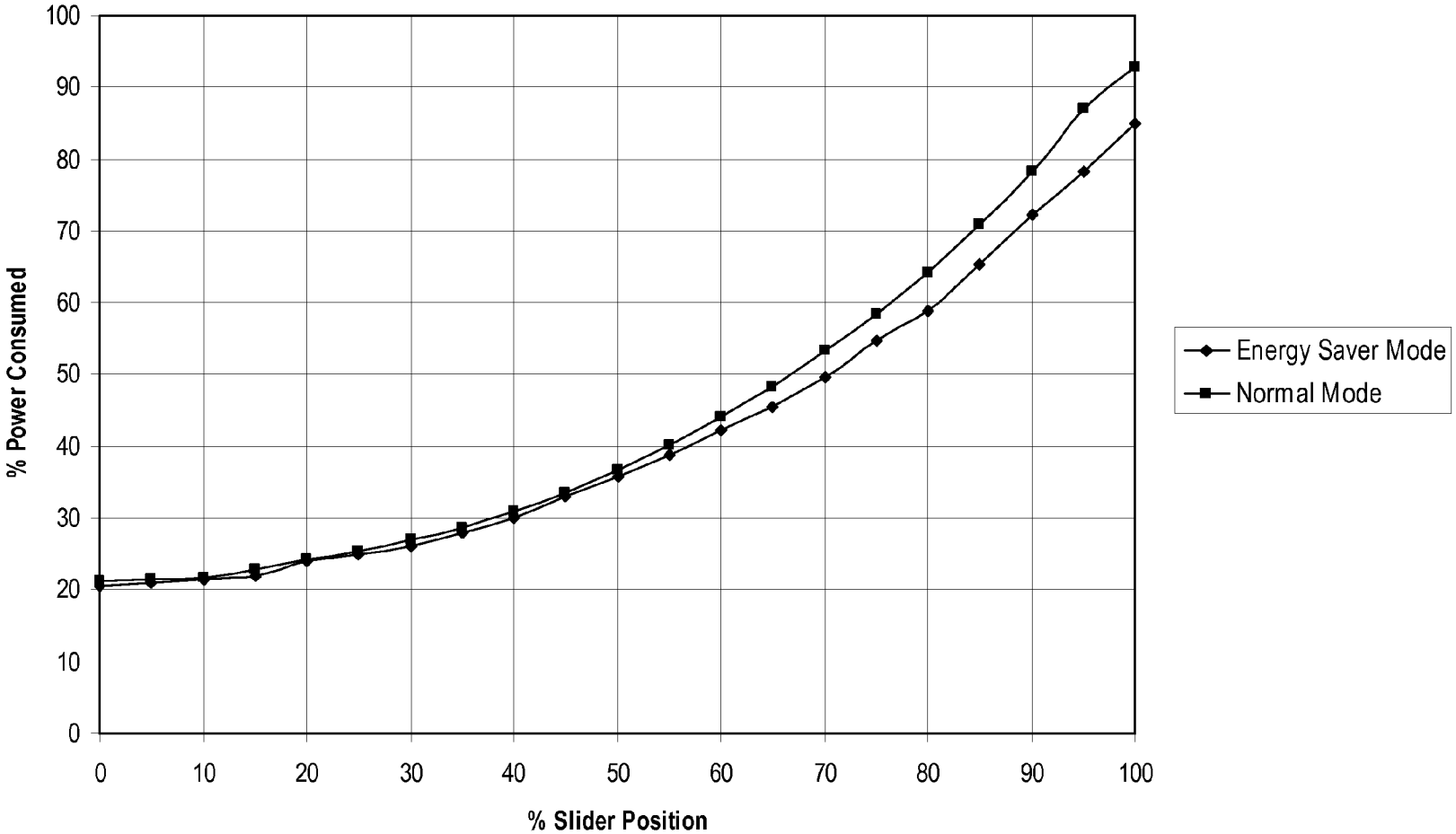
FIG. 4 is a plot of the power delivered to a lighting load controlled by the dimmer switch of FIG. 1 versus the position of a slider actuator of the dimmer switch when operated in a normal mode and an energy saver mode.

FIG. 4 is a plot of the power delivered to the lighting load 108 versus the position of a slider actuator 14 of the dimmer switch 10 when operated in the normal mode and the energy saver mode. When the dimmer switch 10 is operated in the energy saver mode, the power delivered to the lighting load 108 at 100% (i.e., at high-end) is less than the power delivered to the lighting load at high-end when the dimmer switch is in the normal mode. As shown by FIG. 4, the power delivered to the lighting load 108 at 0% (i.e., at low-end) is substantially the same when the dimmer switch is operating in the energy saver mode and the normal mode.

Figure 5:
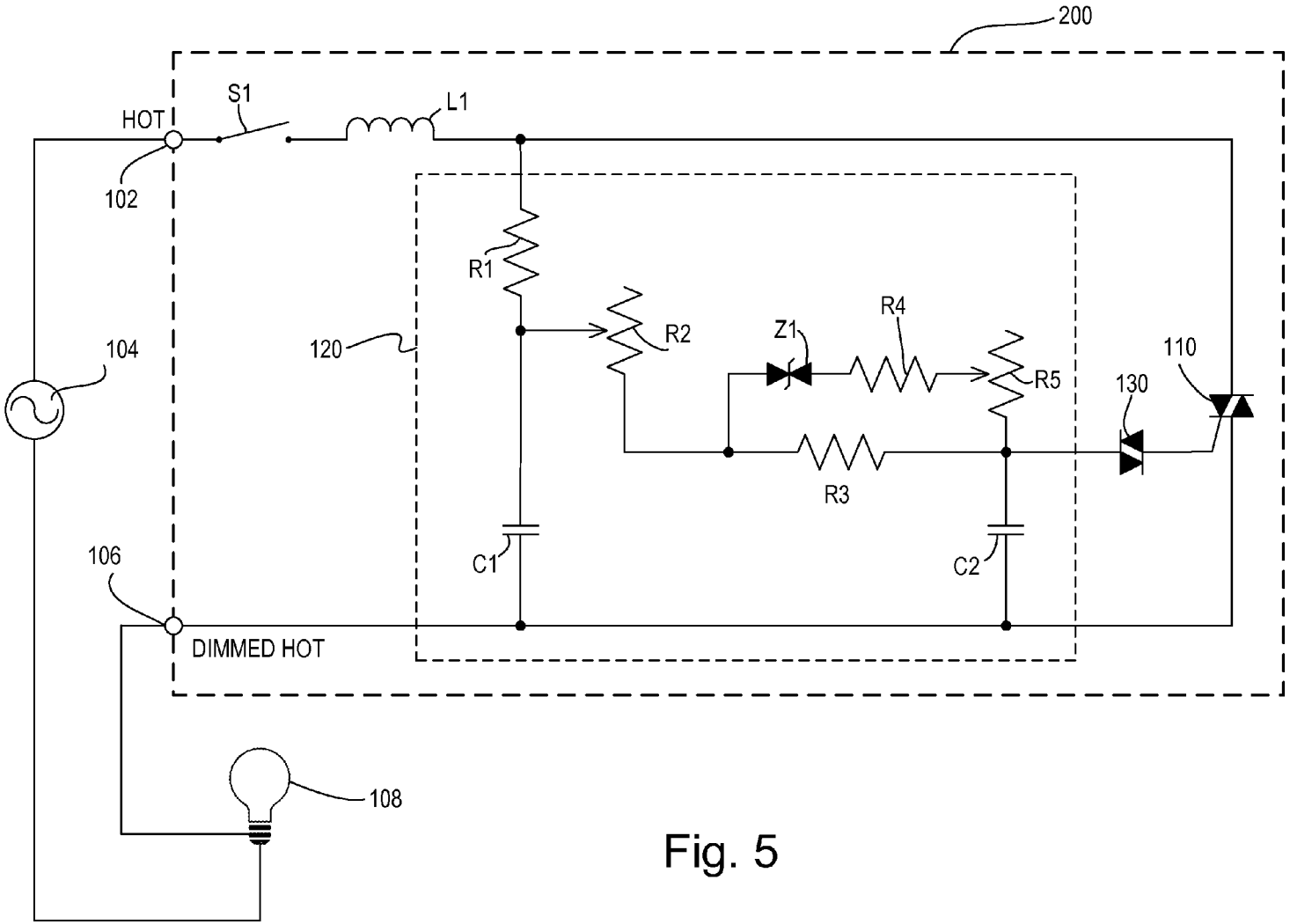
FIG. 5 is a simplified electrical schematic diagram of a dimmer switch according to a second embodiment of the present invention.

FIG. 5 is a simplified electrical schematic diagram of a dimmer switch 200 according to a second embodiment of the present invention. Rather than including the switch S2, the dimmer switch 200 comprises a potentiometer R5 for adjusting the high-end trim. The potentiometer R5 has a wiper lead that is connected to the second lead of the resistor R4 and a second lead connected to the junction of the resistor R3, the capacitor C2, and the diac 130. Preferably, potentiometer R5 comprises an adjustment member, such as a slider control or a rotary knob, which is provided in an opening in the yoke 22 or between the bezel 18 and the yoke 22 (e.g., the opening 32 shown in FIGS. 1 and 2). The potentiometer R5 preferably has a value that can be varied from a minimum resistance (e.g., approximately 0Ω) up to a maximum value of about 1 MΩ. When the resistance of the potentiometer R5 is substantially 0Ω, the dimmer 200 operates at the first nominal high-end trim level (as does the dimmer 10 of FIG. 3 when the switch S2 is closed). As the resistance of the potentiometer R5 is increased, the current through the series combination of the transient voltage suppressor Z1, the resistor R4, and the potentiometer R5 decreases. Thus, the adjustable high-end trim of the dimmer 200 continuously decreases as the resistance of the potentiometer R5 is increased (and vice versa). When the potentiometer R5 is at the maximum resistance, the adjustable high-end trim is at a minimum reduced high-end trim level.

Figure 6:
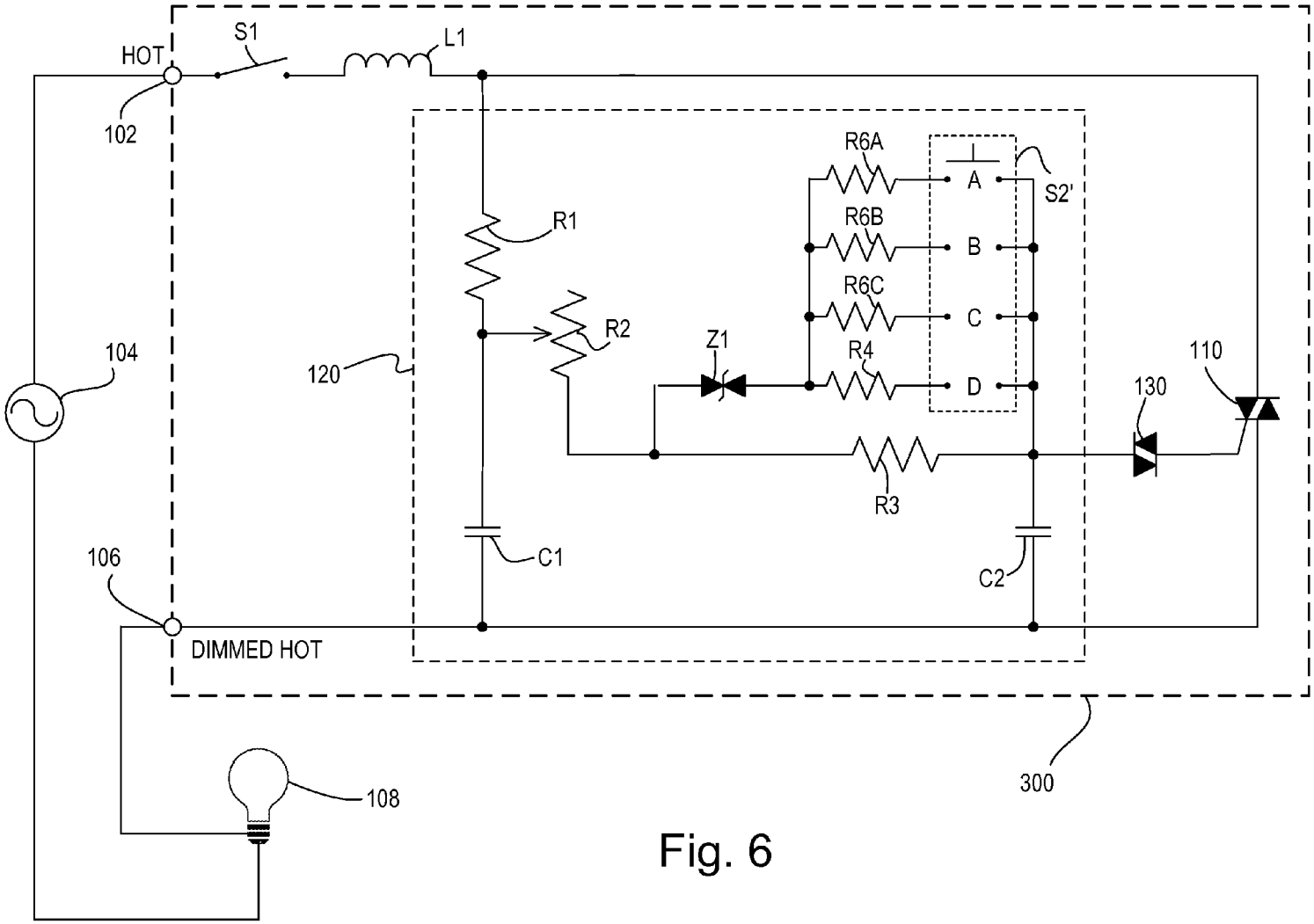
FIG. 6 is a simplified electrical schematic diagram of a dimmer switch according to a third embodiment of the present invention.

FIG. 6 is a simplified electrical schematic diagram of a dimmer switch 300 according to a third embodiment of the present invention. The dimmer switch 300 comprises a multi-position switch S2', having four (4) positions A, B, C, D. Three resistors R6A, R6B, R6C are coupled between the transient voltage suppressor Z1 and the multi-position switch S2'. The transient voltage suppressor Z1 is coupled in series with the first resistor R6A, the second resistor R6B, and the third resistor R6C when the switch S2' is in the first position A, the second position B, and the third position C, respectively. When the switch S2' is in the fourth position D, the series combination of the transient voltage suppressor Z1 and the resistor R4 is simply coupled in parallel with the resistor R3. The first resistor R6A has a first resistance, for example, 63 kΩ. The second resistor R6B has a second resistance, smaller than the first resistance, for example, 56 kΩ. The third resistor R6C has a third resistance, smaller than the second resistance, for example, 45 kΩ. The fourth resistor R4 has a fourth resistance smaller than the third resistance.

When the multi-position switch S2' is in position D, the dimmer switch 300 operates at the nominal high-end trim level (as with the dimmer switch 10 of FIG. 3 when the switch S2 is closed). When the multi-position switch S2' is in position C, the dimmer switch 300 operates at a first reduced high-end trim level, which is less than the nominal high-end trim level. When the multi-position switch S2' is in position B, the dimmer switch 300 operates at a second reduced high-end trim level, which is less than the first reduced high-end trim level. When the multi-position switch S2' is in position A, the dimmer switch 300 operates at a third and minimum reduced high-end trim level, which is less than the second reduced high-end trim level.

Figure 7:
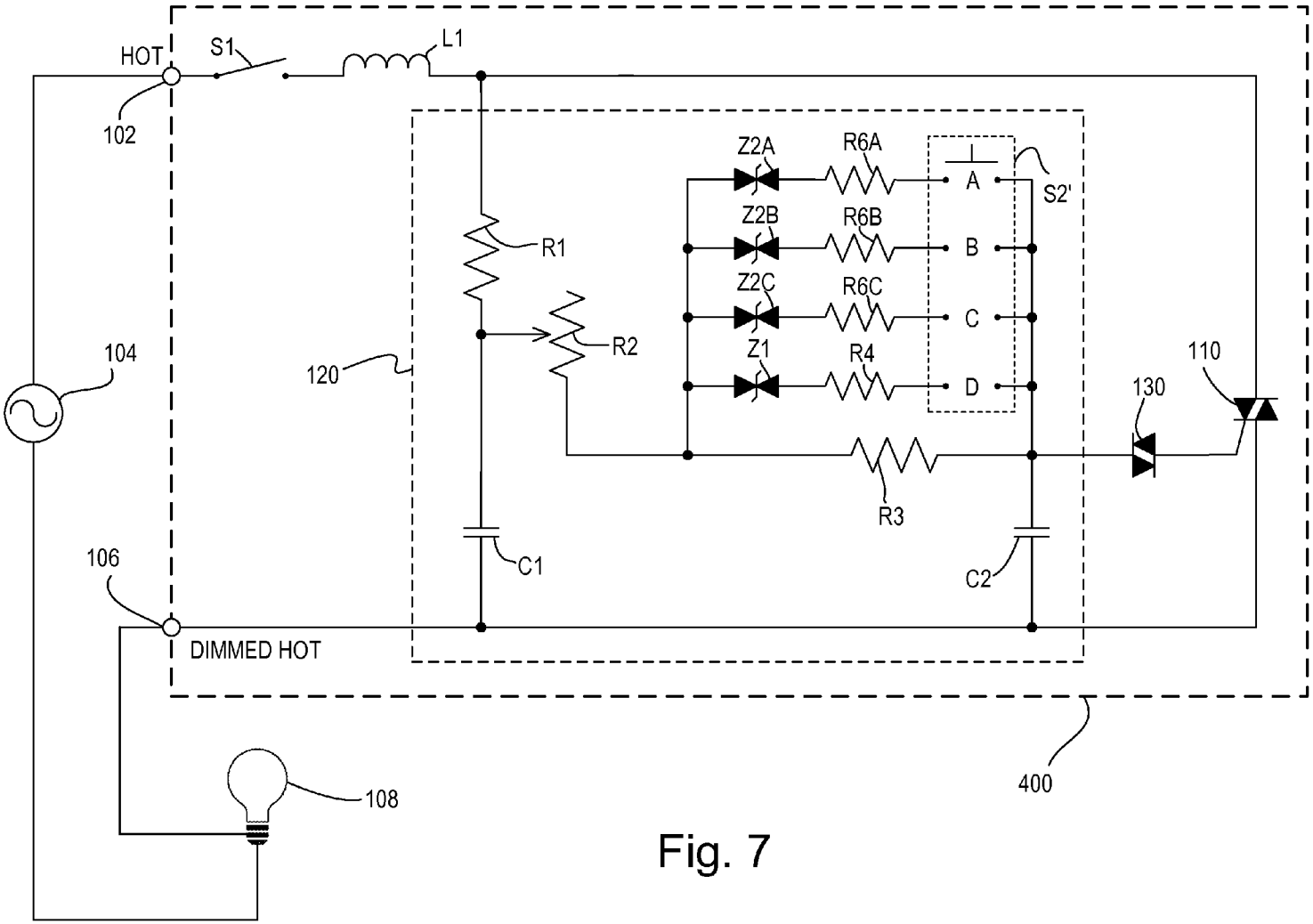
FIG. 7 is a simplified electrical schematic diagram of a dimmer switch according to a fourth embodiment of the present invention.

FIG. 7 is a simplified electrical schematic diagram of a dimmer switch 400 according to a fourth embodiment of the present invention. The dimmer switch 400 comprises three separate transient voltage suppressors Z2A, Z2B, Z2C coupled in series with each of the resistors R6A, R6B, R6C, respectively. Like the dimmer switch 300 of FIG. 6, the dimmer switch 400 operates at the nominal high-end trim level when the multi-position switch S2' is in position D. When the multi-position switch S2' is in positions A, B, C, the dimmer switch 400 operates at one of a plurality of reduced high-end trim levels. Each of the plurality of reduced high-end trim levels is determined by the breakover voltage $V_Z$ of the transient voltage suppressor Z2A, Z2B, Z2C and the resistance of the resistor R6A, R6B, R6C that are coupled in series with the respective switch position A, B, C. The first transient voltage suppressor Z2A has, for example, a breakover voltage $V_Z$ of 60V. The second transient voltage suppressor Z2B has, for example, a breakover voltage $V_Z$ of 51V. The third transient voltage suppressor Z3A has, for example, a breakover voltage $V_Z$ of 42V.

Figure 8:
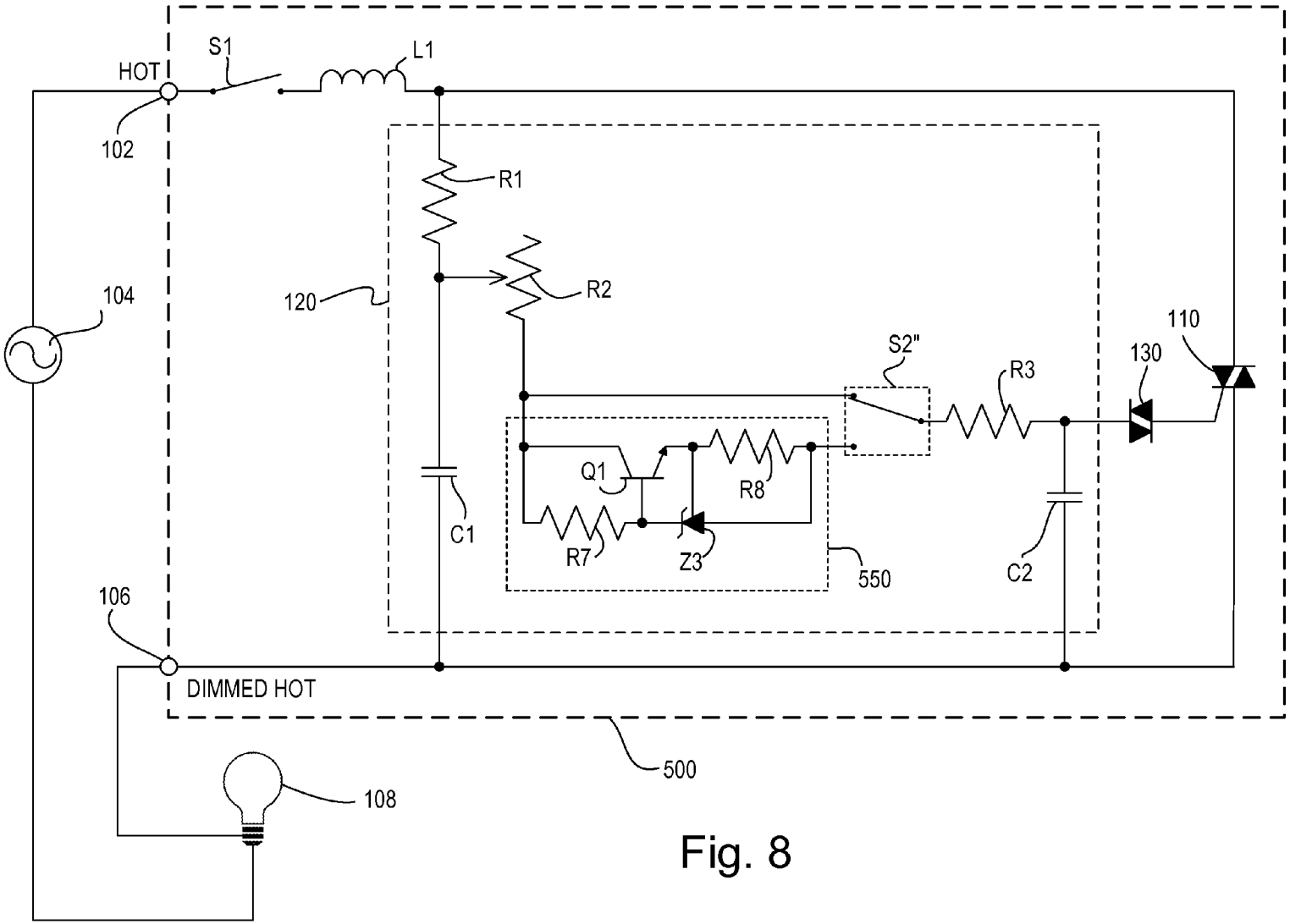
FIG. 8 is a simplified electrical schematic diagram of a dimmer switch according to a fifth embodiment of the present invention.

FIG. 8 is a simplified electrical schematic diagram of a dimmer switch 500 according to a fifth embodiment of the present invention. The dimmer switch 500 comprises a single-pole double-throw (SPDT) switch S2" and a current-limiting circuit 550. The SPDT switch S2" has a movable contact coupled to the resistor R3 and two fixed contacts coupled to the potentiometer R2 and the current limiting circuit 550. The current-limiting circuit 550 comprises an NPN bipolar junction transistor Q1, two resistors R7, R8 and a shunt regulator zener diode Z3.

When the switch S2" is in a first position, the potentiometer R2 is simply coupled in series with the resistor R3. When the switch S2" is in a second position, the current-limiting circuit 550 is coupled in series between the potentiometer R2 and the resistor R3. As a voltage develops across the current-limiting circuit 550, current flows through the resistor R7 (which preferably has a resistance of 33 kΩ) and into the base of the transistor Q1, such that a limited current $I_{LIMIT}$ flows through the main leads of the transistor. The shunt diode Z3 preferably has a shunt connection coupled to the emitter of the transistor Q1 to limit the magnitude of the limited current $I_{LIMIT}$. The magnitude of the limited current $I_{LIMIT}$ is determined by the reference voltage of the shunt diode Z3 and the resistance of the resistor R8. Preferably, the shunt diode Z3 has a reference voltage of 1.8V and the resistor R8 has a resistance of 392Ω.

When the switch S2" is in the second position, the limited current $I_{LIMIT}$ causes the capacitor C2 to charge at a slower rate than when the switch S2" is in the first position. Therefore, the triac 110 begins conducting at a later time than when the switch S2" is in the first position. Accordingly, the dimmer switch 500 operates at the nominal high-end trim level when the switch S2" is in the first position, and at the reduced high-end trim level when the switch S2" is in the second position.

Figure 9:
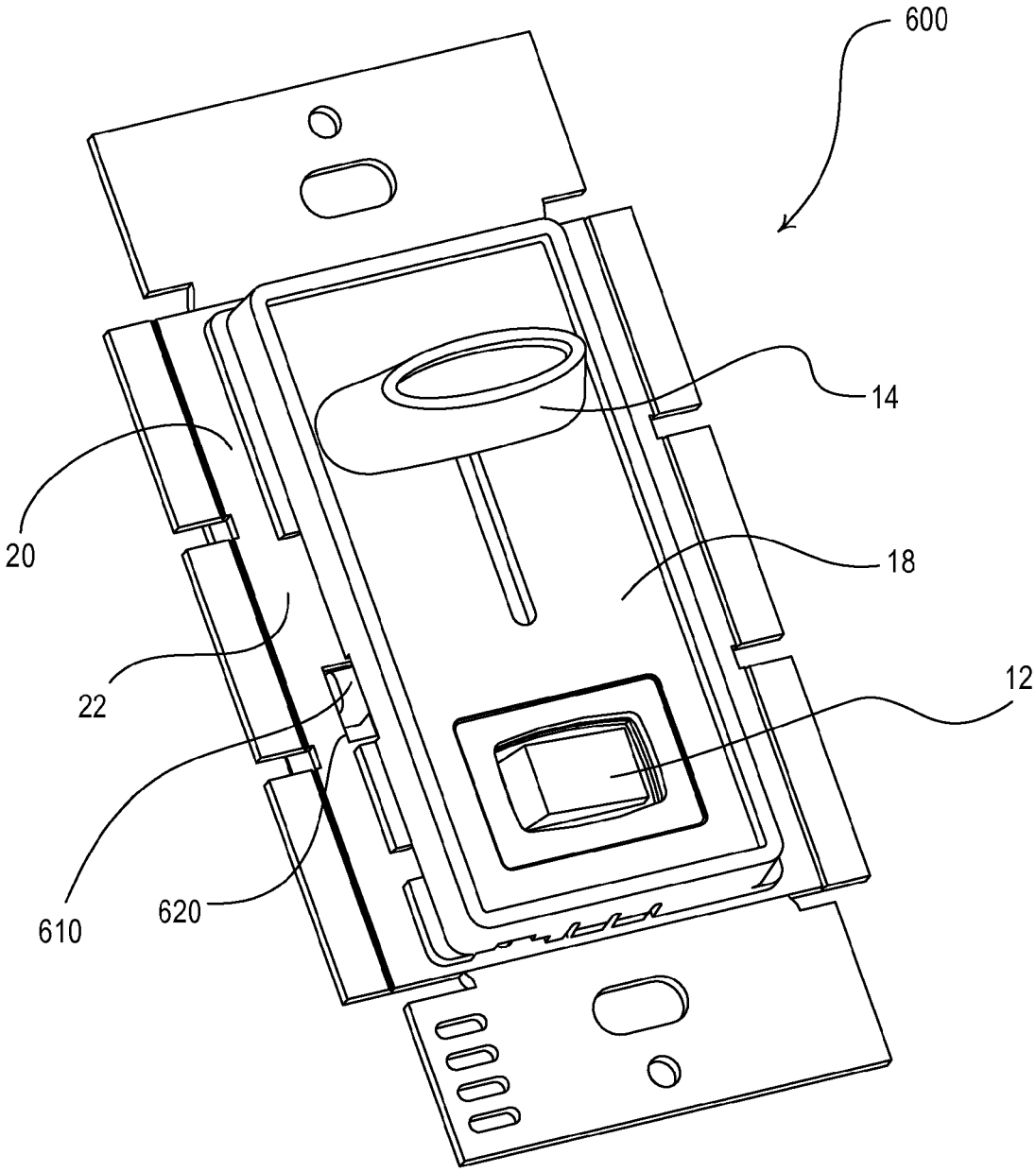
FIG. 9 is a perspective view of the user interface of a dimmer switch having adjustable high-end trim according to a sixth embodiment of the present invention.
Figure 10:
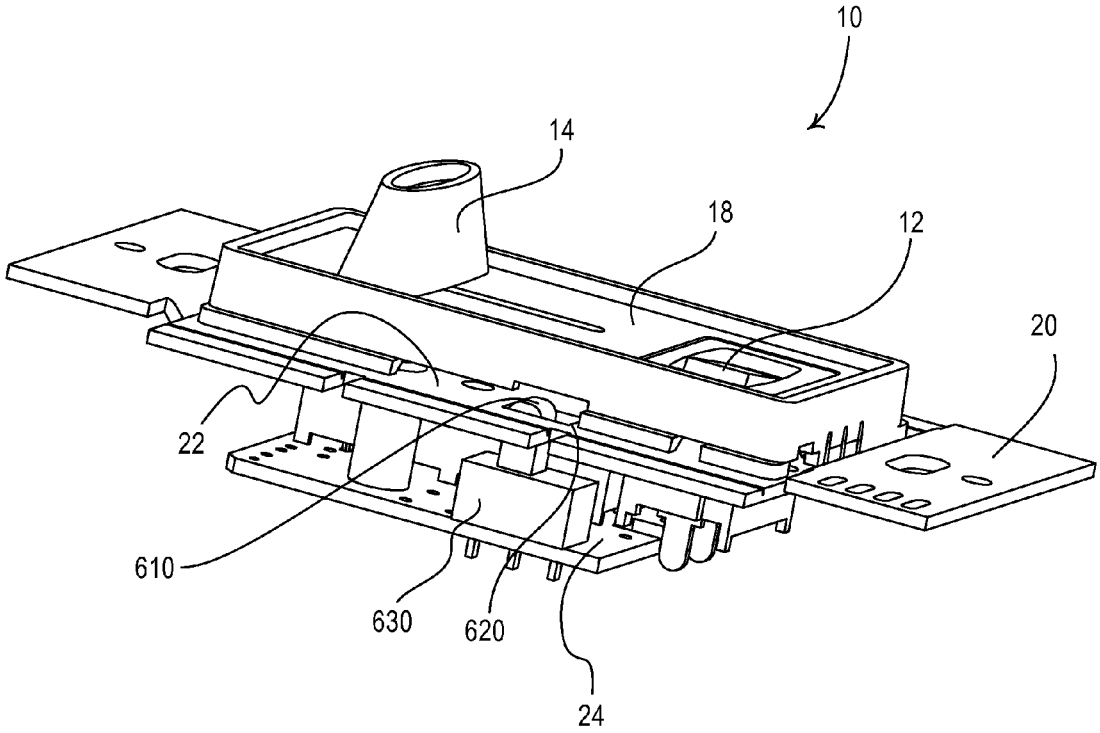
FIG. 10 is another perspective view of the user interface of FIG. 9.

FIG. 9 and FIG. 10 are perspective views of the user interface of a dimmer switch 600 having adjustable high-end trim according to a sixth embodiment of the present invention. The dimmer switch 600 includes a high-end trim adjustment actuator 610, which is provided in an opening 620 of the mounting yoke 22. Since the high-end trim adjustment actuator 610 comprises simply a mechanical switch 630 mounted to the printed circuit board 24, the coupling member 28 of the dimmer switch 10 (shown in FIGS. 1 and 2) is not required. Note that the mechanical switch 630 may comprise any of the switches S2, S1', or S2" (of FIGS. 3, 6, 7, and 8). The adjustment actuator 610 is located such that the adjustment actuator cannot be seen when a faceplate is mounted to the dimmer switch 600, but can be accessed when the faceplate is removed.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A load control device with an adjustable high-end trim for controlling the amount of power delivered to an electrical load from an AC power source, the load control device comprising:

a bidirectional semiconductor switch coupled in series electrical connection between the source and the load, and operable to control the amount of power delivered to the electrical load between a low-end trim and the adjustable high-end trim, the semiconductor switch having a control input for controlling the semiconductor switch in response to a firing voltage signal derived entirely from analog control circuitry; and a user-accessible adjustment actuator for adjusting the high-end trim of the load control device from a first level to a second level lower than the first level, the adjustment actuator mounted on a front surface of the load control device, the adjustment actuator inaccessible to a user when a faceplate is mounted on the load control device, the adjustment actuator accessible to a user when the faceplate is not mounted on the load control device;

wherein actuations of the user-accessible adjustment actuator have substantially no affect upon the low-end trim of the load control device.

2. The load control device of claim 1, further comprising:

a triggering circuit for rendering the semiconductor switch conductive each half-cycle of the AC power source; and a timing circuit coupled in parallel electrical connection with the semiconductor switch for generating the firing voltage signal;

wherein the triggering circuit is operable to control the semiconductor switch in response to the firing voltage signal.

3. The load control device of claim 2, wherein the adjustment actuator comprises a mechanical switch, and the timing circuit comprises:

a first resistor;

a capacitor coupled to the first resistor and operable to conduct a charging current from the power source through the first resistor such that the firing voltage signal is produced across the capacitor; and a transient voltage suppressor coupled in series electrical connection with the mechanical switch, the series combination of the transient voltage suppressor and the mechanical switch coupled in parallel electrical connection with the first resistor.

4. The load control device of claim 3, wherein the mechanical switch comprises a single-pole single-throw (SPST) switch.

5. The load control device of claim 4, wherein the load control device operates with a nominal high-end trim level when the SPST switch is closed, and with a reduced high-end trim level when the SPST switch is open.

6. The load control device of claim 4, wherein the timing circuit further comprises a second resistor coupled in series electrical connection with the transient voltage suppressor and the SPST switch.

7. The load control device of claim 3, wherein the mechanical switch comprises a multi-position switch having a plurality of switch positions, and the timing circuit further comprises a plurality of resistors, each coupled in series electrical connection with one of the plurality of switch positions, the plurality of resistors all coupled in series with the transient voltage suppressor, the load control device operating with a nominal high-end trim level when the multi-position switch is in a first switch position, and with a plurality of reduced high-end trim levels when the multi-position switch is in one of the plurality of switch position, different from the first switch position.

8. The load control device of claim 3, wherein the mechanical switch comprises a multi-position switch having a plurality of switch positions, and the timing circuit further comprises a plurality of resistors, each coupled in series electrical connection with one of the plurality of switch positions, and a plurality of transient voltage suppressors, each coupled in series electrical connection with one of the plurality of resistors, the load control device operating with a nominal high-end trim level when the multi-position switch is in a first switch position, and with a plurality of reduced high-end trim levels when the multi-position switch is in one of the plurality of switch position, different from the first switch position.

9. The load control device of claim 3, wherein the transient voltage suppressor comprises two zener diodes connected in series in reverse order.

10. The load control device of claim 2, wherein the adjustment actuator comprises a single-pole double-throw (SPDT) switch, and the timing circuit comprises:

a first resistor coupled to a movable contact of the SPDT switch;

a capacitor coupled to the first resistor and operable to conduct directly from the power source through the first resistor a charging current having a first magnitude when the SPDT switch is in a first position, whereby the firing voltage signal is produced across the capacitor; and a current limiting circuit operable to limit the charging current to a second magnitude less than the first magnitude when the SPDT switch is in a second position.

11. The load control device of claim 10, wherein the load control device operates with a nominal high-end trim level when the SPDT switch is in the first position, and with a reduced high-end trim level when the SPDT switch is in the second position.

12. The load control device of claim 10, wherein the current limiting circuit comprises a shunt regulator zener diode having an anode coupled to a second fixed contact of the SPDT switch;

a first current-limiting resistor coupled between the anode and a shunt connection of the shunt regulator zener diode;

an NPN bipolar junction transistor having a base coupled to a cathode of the shunt regulator zener diode and an emitter coupled to the shunt connection of the shunt regulator zener diode; and a second current-limiting resistor coupled between the cathode of the shunt regulator zener diode and a collector of the transistor.

13. The load control device of claim 2, wherein the adjustment actuator comprises a potentiometer, and the timing circuit comprises:

a first resistor;

a capacitor coupled to the first resistor and operable to conduct a charging current from the power source through the first resistor such that the firing voltage signal is produced across the capacitor; and a transient voltage suppressor coupled in series electrical connection with a wiper lead of the potentiometer, one of the main leads of the potentiometer coupled to the first resistor such that the series combination of the transient voltage suppressor and the potentiometer is coupled in parallel electrical connection with the first resistor.

14. The load control device of claim 13, wherein the load control device operates with a nominal high-end trim level when the potentiometer has a minimum resistance, and with a minimum reduced high-end trim level when the potentiometer has a maximum resistance; and wherein the adjustable high-end trim of the load control device is continuously variable between the nominal high-end trim level and the minimum reduced high-end trim level.

15. The load control device of claim 1, wherein the controllably conductive device comprises a bidirectional semiconductor switch.

16. The load control device of claim 15, wherein the bidirectional semiconductor switch comprises a triac.

17. The load control device of claim 2, wherein the triggering circuit comprises a diac.

18. The load control device of claim 2, further comprising:

an intensity adjustment actuator for controlling the intensity of the lighting load;

wherein the timing circuit further comprises a potentiometer coupled in series with the first resistor and is responsive to the intensity adjustment actuator.

19. The load control device of claim 1, further comprising:

a mounting yoke for attaching the faceplate to the load control device;

wherein the high-end trim adjustment actuator extends through an opening in the mounting yoke.

20. The load control device of claim 1, further comprising:

a mounting yoke for attaching the faceplate to the load control device; and a bezel coupled to the mounting yoke, and received in an opening of the faceplate;

wherein the high-end trim adjustment actuator extends through an opening between the mounting yoke and the bezel.

* * * * *